US005485645A

United States Patent [19]

Ohtsuki

[11] Patent Number: 5,485,645

[45] Date of Patent: Jan. 23, 1996

[54] OUTER WALL CLEANING ROBOT

[75] Inventor: Shigeru Ohtsuki, Tokyo, Japan

[73] Assignee: Nihon Biso Co., Ltd., Tokyo, Japan

[21] Appl. No.: 270,906

[22] Filed: Jul. 5, 1994

[30] Foreign Application Priority Data

Oct. 20, 1993 [JP] Japan ..... 5-285897

[51] Int. Cl.[6] ..... A47L 1/02

[52] U.S. Cl. ..... 15/103; 15/4; 15/50.3

[58] Field of Search ..... 15/4, 50.1, 50.3, 15/98, 103, 250.11, 302

[56] References Cited

U.S. PATENT DOCUMENTS

| | | | |
|---|---|---|---|
| 3,461,476 | 8/1969 | North | 15/103 |
| 3,715,774 | 2/1973 | Fannon, Jr. | 15/302 |
| 3,895,406 | 7/1975 | Fannon, Jr. | 15/302 |
| 4,198,724 | 4/1980 | Fisher et al. | 15/302 |
| 4,800,607 | 1/1989 | Fukutomi | 15/302 |
| 4,809,384 | 3/1989 | Yokota et al. | 15/103 |
| 5,020,180 | 6/1991 | Mimura | 15/250.11 |
| 5,086,533 | 2/1992 | Kitahara | 15/103 |
| 5,116,424 | 5/1992 | Steinhart et al. | 15/103 |

FOREIGN PATENT DOCUMENTS

| | | | |
|---|---|---|---|
| 26770 | 2/1977 | Japan | 15/50.1 |
| 26771 | 2/1977 | Japan | 15/103 |
| 10566 | 1/1979 | Japan | 15/250.11 |

*Primary Examiner*—Mark Spisich
*Attorney, Agent, or Firm*—Hedman, Gibson & Costigan

[57] ABSTRACT

An ( ) outer wall cleaning robot includes an arm pivotable about a first rotation axis and a rotational body supported by the arm for pivotal movement about a second rotation axis. The rotational body can be driven independently of a pivotal movement of the arm. To the rotational body are attached respective mounting mechanisms for a wiping squeegee and a receiving squeegee.

6 Claims, 12 Drawing Sheets

OUTER WALL CLEANING ROBOT

BACKGROUND OF THE INVENTION

The present invention relates to robots for cleaning the outer wall surface of buildings or other constructions which has windows, and particularly to robots for cleaning windows of buildings.

Along with modern buildings getting higher and higher, the number of windows provided on the outer surface of these high-rise buildings has been increasing remarkably. In order to keep the windowpanes clean, it is necessary to clean them on a periodical basis.

In the past, windowpanes of high-rise buildings were cleaned mostly by manual operations, where, fox example, a cleaning operator, riding on a gondola hung down from the building rooftop, sprinkled clear water onto the windowpanes and then wiped up the water with a squeegee or the like. But, such traditional manual operations provided very poor cleaning efficiency and also was very dangerous.

As an approach to solve the problems, window cleaning robots have been developed and widely employed today which are capable of cleaning windowpanes in a highly-mechanized or automatic manner. In general, such prior window cleaning robots include working components commonly called gate-type squeegees, which are caused to perform its upward/downward, forward/rearward and tilting movements based on the principle of Cartesian (orthogonal) coordinates.

As shown in FIG. 12, the prior window cleaning of this type comprise a head case c having opposite side portions vertically slidably fitted about two linear guide shafts b, which are secured to a frame a hung down from the rooftop of a building via wire ropes r. To the head case c is connected a pair of motor-driven cylinders d for extending and retracting a wiping squeegee e. The wiping squeegee e and receiving squeegee f are connected to the pistons of the motor-driven cylinders d in such a manner that the two squeegees e and f are movable toward and away from the outer wall surface the building (forward/rearward movement). Each of the opposite side portions is further connected to an endless chain that is wound at its both ends around upper and lower sprocket wheels g and h, and the lower sprocket wheel h is connected to a drive shaft j. The drive shaft j is driven or rotated by a motor k, and rotation of the drive shaft j causes the head case c to move in an upward and downward direction along the linear guide shafts b. Further, to the head case c is fixed another pair of motor-driven cylinders 1 for pivotally moving the squeegee e in a vertical direction. Driving this motor-driven cylinder 1 can change the tilt angle of the wiping squeegee e (titling movement).

The present needs with the window cleaning robots are that they are capable of performing intended cleaning operations accurately; they have high reliability to guarantee non-occurrence of failure, damage etc.; they are small and light enough to substantially reduce the size of a roof car suspending the robot from a rooftop; and they are capable of performing cleaning operations at rapid speed and over a wide area.

However, from such a point of view, the prior art window cleaning robots constructed on the orthogonal coordinates principle are not satisfactory in the following points.

The drive shaft that is provided for vertically moving the head case c securing the two squeegees is subjected to a heavy load imparted from the squeegees e, f and head case c and hence tends to be easily damaged, resulting in poor reliability. To enhance reliability, the drive shaft and drive mechanisms associated with the drive shaft must have an increased size.

In addition, with the prior window cleaning robots, a large amount of dirty water and dirt tends to scatter all over during the window cleaning, and various robot components, drive-power transmission mechanisms in particular, must be completely covered or sealed to prevent failure and rust occurring due to adhesion of the soiled water and dirt. However, in fact, it is difficult to provide such complete sealing because the drive-power transmission mechanisms contain many sliding members. This lack of complete sealing also results in poor reliability.

Further, the drive shaft for vertically moving the head case c tends to be twisted as rotational force is transmitted from the sprocket wheel on one side of the head case c to the sprocket wheel on the other side, and this twist can cause delay in the driving-power transmission, with the result that the squeegees can not be maintained in an accurate horizontal position. This also provides poor reliability.

Furthermore, because separate drive mechanisms are employed to perform the upward/downward, forward/rearward and tilting movements, the number of parts is increased and the entire mechanisms become large in size, so that it is difficult to reduce the size and weight of the robot and hence the roof car hanging the robot.

Moreover, with the prior window cleaning robots based on the orthogonal coordinates principle, the wiping squeegee e, receiving squeegee f, motor-driven cylinders d, 1 are attached to the head case c, and thus an extremely heavy load is imparted to the head case c. This heavy load makes it difficult to increase the operation speed of the head case c. In addition, the drive mechanism for the head case c is comprised of many components such as the chains and drive shafts and forms complicated drive-power transmission channels. This also prevents high-speed operation of the head case c.

It is therefore an object of the present invention to provide an improved outer wall cleaning robot which can effectively avoid problems arising from the use of a drive shaft, such as damage to the drive shaft and can completely seal drive-power transmission mechanisms of the robot and which further achieves reduced weight and high-speed operation of the robot.

SUMMARY OF THE INVENTION

In order to achieve the above-mentioned objects, an outer wall cleaning robot according to the invention comprises an arm pivotable about a first rotation axis that extends in a substantially horizontal direction in approximately parallel relation to an outer wall surface of a building, an arm driving mechanism for driving the arm, a rotational body supported by the arm in such a manner that the rotational body is pivotable about a second rotation axis extending in parallel with the first rotation axis, a rotational-body driving mechanism for driving the rotational body independently of driving of the arm by the arm driving mechanism, a wiping-squeegee mounting mechanism attached to the rotational body, and a wiping squeegee attached to the mounting mechanism.

According to the invention, actuation of the arm driving mechanism causes the arm to pivot about the first rotation axis, and actuation of the rotational-body driving mechanism causes the rotational body to pivot about the second rotation axis independently of the pivotal movement of the arm. Thus, the upward/downward, forward/rearward and tilting movements of the wiping squeegee attached to the wiping-squeegee mounting mechanism can all be achieved by combination of the pivotal movements of the arm and rotational body.

An outer wall cleaning robot according to one aspect of the invention includes, in addition to the above described elements, a receiving-squeegee mounting mechanism pivotably supported relative to the rotational body, a receiving squeegee attached to the receiving-squeegee mounting mechanism so as to be positioned below the wiping squeegee, for receiving dirty water resultant from cleaning of the outer wall, a clutch mechanism for connecting or disconnecting the receiving squeegee to or from the rotational body, and a stopper mechanism for preventing the receiving squeegee from pivoting downward from a predetermined position.

According to this aspect of the invention, the receiving-squeegee mounting mechanism rotatably supported relative to the rotational body is connected to or disconnected from the rotational body via the clutch mechanism: when the clutch is in the connecting state, the receiving squeegee is pivotable together with the rotational body, but when the clutch is in the disconnecting state, the receiving squeegee is held in a predetermined position (horizontal position, for instance) irrespective of the pivotal movement of the rotational body, with its tendency to pivot downward due to its dead weight being cons trained by a stopper mechanism. Thus, in the case of a normal window cleaning operation, upon detection of a window frame existing ahead in the cleaning direction, the clutch is put in the connecting state and thus the receiving squeegee, together with the wiping squeegee, moves away from the windowpane surface to avoid the obstructing window frame. During the cleaning operation, because the clutch is maintained in the disconnecting state, the receiving squeegee can perform control to rotate the rotational body so as to adjust the wiping squeegee to an optimum tilted position for cleaning, and the receiving squeegee can also be maintained in a predetermined position for receiving dirty water irrespective of the control of the pivotal movement of the wiping squeegee.

An outer wall cleaning robot according to another aspect of the invention, in addition to the above described structural feature, is characterized in that the arm mounting mechanism and the rotational-body driving mechanism are provided separately from the arm.

According to another aspect of the invention, the wiping-squeegee mounting mechanism comprises a squeegee mounting section to which said mounting squeegee is fixedly secured, and a squeegee mounting section supporting section having a vertical pin located approximately in the central portion of said squeegee mounting section and on which said squeegee mounting section is horizontally pivotably mounted.

According to this aspect of the invention, when the robot is not in parallel to the the plane of the windowpane, the squeegee mounting section is pivoted to obtain a perfect parallel state between the wiping-squeegee and the windowpane plane. Therefore, regardless of whether or not the robot is positioned parallel to the windowpane plane, an ideal parallel state can be achieved between the wiping-sqeegee and the windowpane plane.

Further, according to still another aspect of the invention, said wiping-sqeegee mounting mechanism further comprises drive means coupled to said squeegee mounting section supporting section for driving said squeegee mounting section supporting section toward and away from the outer wall surface of the building, guide means for guiding the movement of said squeegee mounting section supporting section toward and away from the outer wall surface of the building, a pressure sensor for detecting pressure of the wiping-squeegee against a windowpane in association with said squeegee mounting section supporting section, and drive control means for controlling said drive means in such a manner that said squeegee mounting section supporting section is caused to move toward the windowpane when pressure detected by said pressure sensor is below a preset value and said squeegee mounting section supporting section is caused to moved away from the windowpane when pressure detected by said pressure sensor is above the preset value.

According to this aspect of the invention, when there occurs a slight change in the distance between the robot and windowpane during the cleaning work, the pressing pressure of the wiping-squeegee against the windowpane is maintained at a constant value so that an optimum pressing force can be maintained.

Now, the preferred embodiment of the present invention will be described in detail below with reference to the accompanying drawings.

DETAILED DESCRIPTION OF THE PREFERRED EMBODIMENT

A detailed description will be given on the general construction of an outer wall cleaning robot in accordance with an embodiment of the present invention, as well as on the construction and operation of individual components of the robot.

Figure 1:
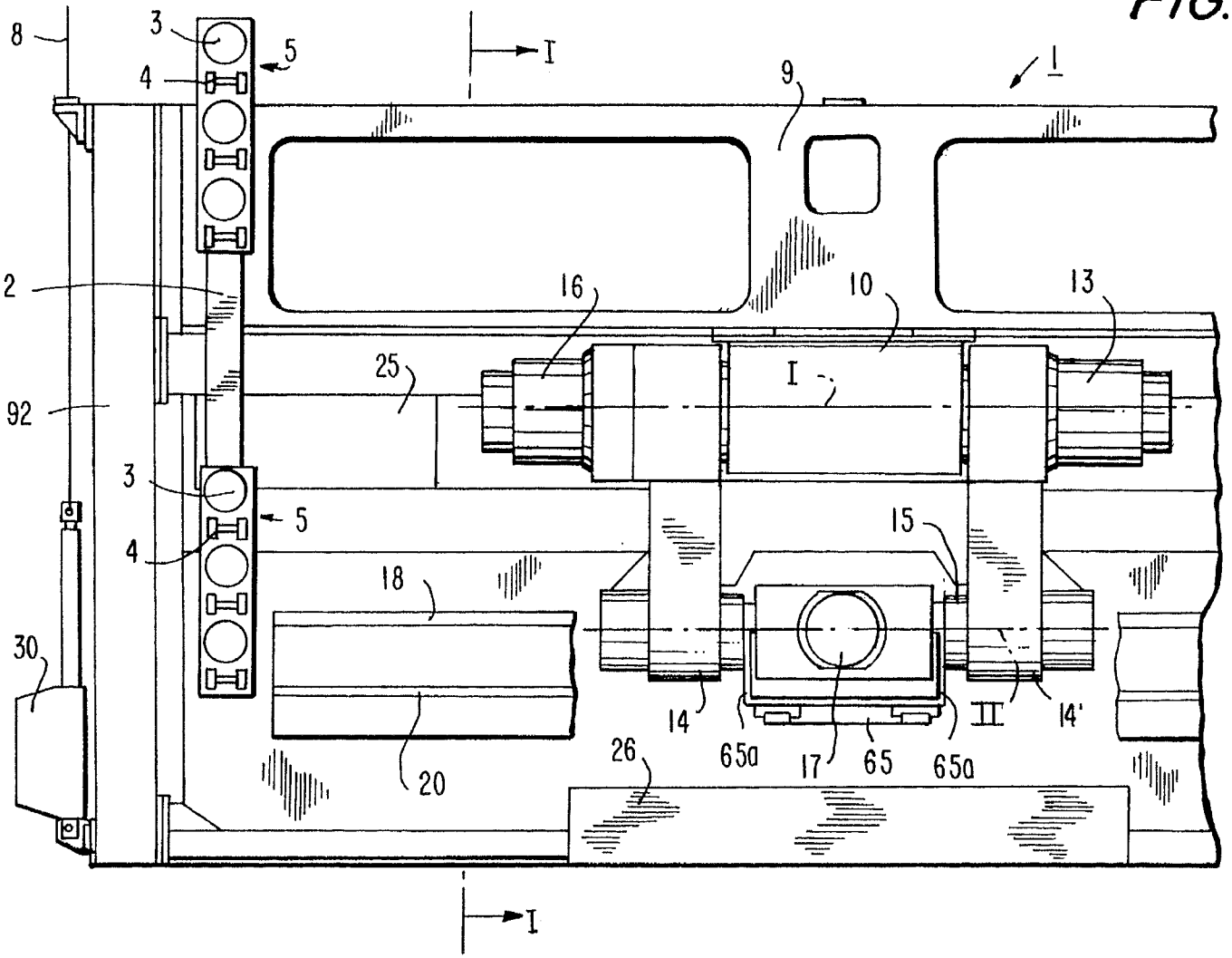
FIG. 1 is a front elevational view of an embodiment of an outer wall cleaning robot in accordance with the present invention.
Figure 2:
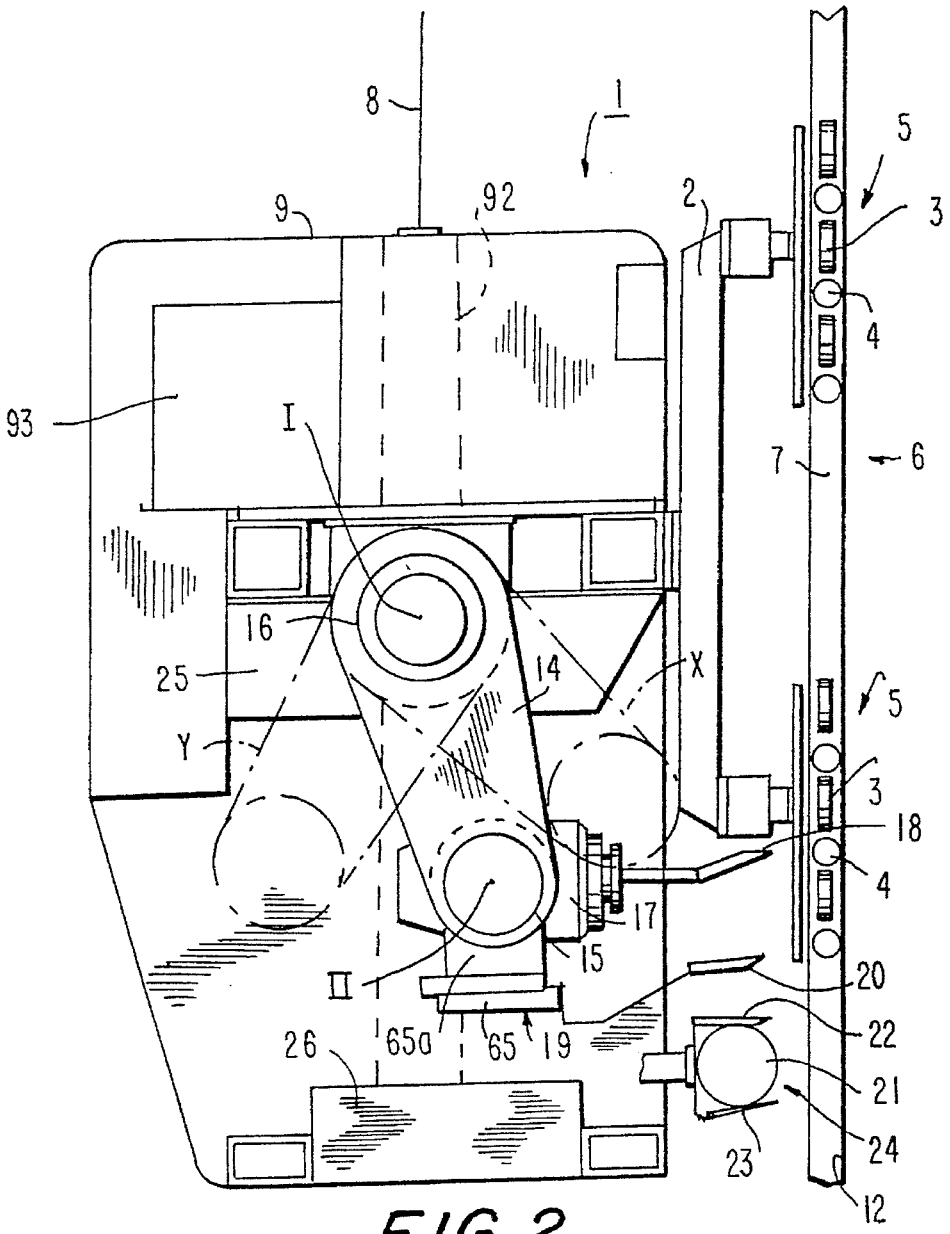
FIG. 2 is a view as viewed in a direction of arrow I—I of FIG. 1.

1. Outline on the General Construction of the Robot:

First, the general construction of the outer wall cleaning robot will be outlined with reference to FIGS. 1 and 2. The components of the robot are symmetrically provided about a vertical axis, except for a tilt-correcting cylinder 30 disposed on the left of the figure, and therefore illustration of most of the rightside components are omitted in FIG. 1 for simplicity.

Figure 3:
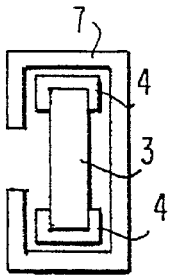
FIG. 3 is a top plan view showing a manner in which guide rollers are fitted within a guide roller rail in the embodiment.

On both sides of the outer wall cleaning robot 1, guide roller supporting frames 2 are disposed, to each of which pair of upper and lower guide rollers 5 is attached. Each of the guide roller 5 includes a combination of a large roller 3 and a small roller 4 whose rotation axes are disposed perpendicularly to each other. A detailed description on the construction of the guide rollers 5 will not be given here because such guide rollers are well known in the art of window cleaning robots, as typically disclosed in Japanese Patent Laid-open Publication No. SHO 4-332513. As shown in FIGS. 2 and 3, the guide rollers 5 are fitted within two guide roller rails 7 that are permanently laid on an outer wall surface of a building 6 and extend in a vertical direction thereof.

Wire ropes 8 are secured to supports 92 on both sides of the robot 1, and each of the wire ropes 8 is wound at one end around a drum provided on a roof car (not shown) positioned on the rooftop of the building 6. Winding or unwinding the wire ropes 8 by the drums causes the robot 1 to ascend or descend along the guide roller rails 7.

The tilt-correcting cylinder 30 is provided on the lower left end portion (as viewed in FIG. 1) of the robot 1. When the robot 1 has tilted from a predetermined horizontal position, the cylinder 30 corrects the tilt to restore the robot 1 to the predetermined horizontal position.

A cylindrical bases 10 is fixed to a frame 9 of the robot 1. The base 10 supports thereon a pair of box-shaped arms 14, 14' rotatable about a first rotation axis I extending substantially in a horizontal direction in substantially parallel relation to the outer surface 12. The arms 14, 14' are integrally connected with each other and are pivotable, by means of an electric motor 13 provided adjacent to the arm 14', between positions X and Y as denoted in dot-and-dash lines in FIG. 2.

Further, in FIG. 1, a rotation shaft 15 constituting a rotational body is supported on the arms 14, 14 ' in such a manner that the rotational body 15 can rotate about a second rotation axis II extending in parallel with the above-mentioned first rotation axis I. The rotational body 15 is rotatable, independently of the pivotal movement by the arms 14, 14', by an electric motor 16 that is provided adjacent to the arm 14 via a drive mechanism provided within the arm 14.

A wiping-squeegee mounting mechanism 17 is disposed on the central portion of the rotation shaft 15. To this mounting mechanism 17 is attached a wiping squeegee 18 which is made of rubber or the like and extends horizontally in parallel with the outer wall surface 12. A receiving-squeegee mounting mechanism 19 is also disposed on the central portion of the rotational body 15. To this mounting mechanism 19 is attached a receiving squeegee 20 which extends horizontally in parallel with the outer wall surface 12 so as to receive thereon dirty water resultant from cleaning of the outer wall. In FIG. 1, both of the squeegees 18, 20 are shown with their central portions broken away for simplicity.

As shown in FIG. 2, below the receiving squeegee 20, there is provided a rotary brush mechanism 24 which comprised of a rotary brush 21 for removing dirt and dust prior to windowpane cleaning with the wiping squeegee 18, and upper and lower cover squeegees 22, 23 for covering the rotary brush 21 (illustration of the rotary brush mechanism 24 is omitted in FIG. 1). Reference numeral 25 denotes a clean water supply tank, 26 denotes a soiled water tank for storing dirty water resultant from the windowpane cleaning, and 93 denotes a control panel.

Figure 4:
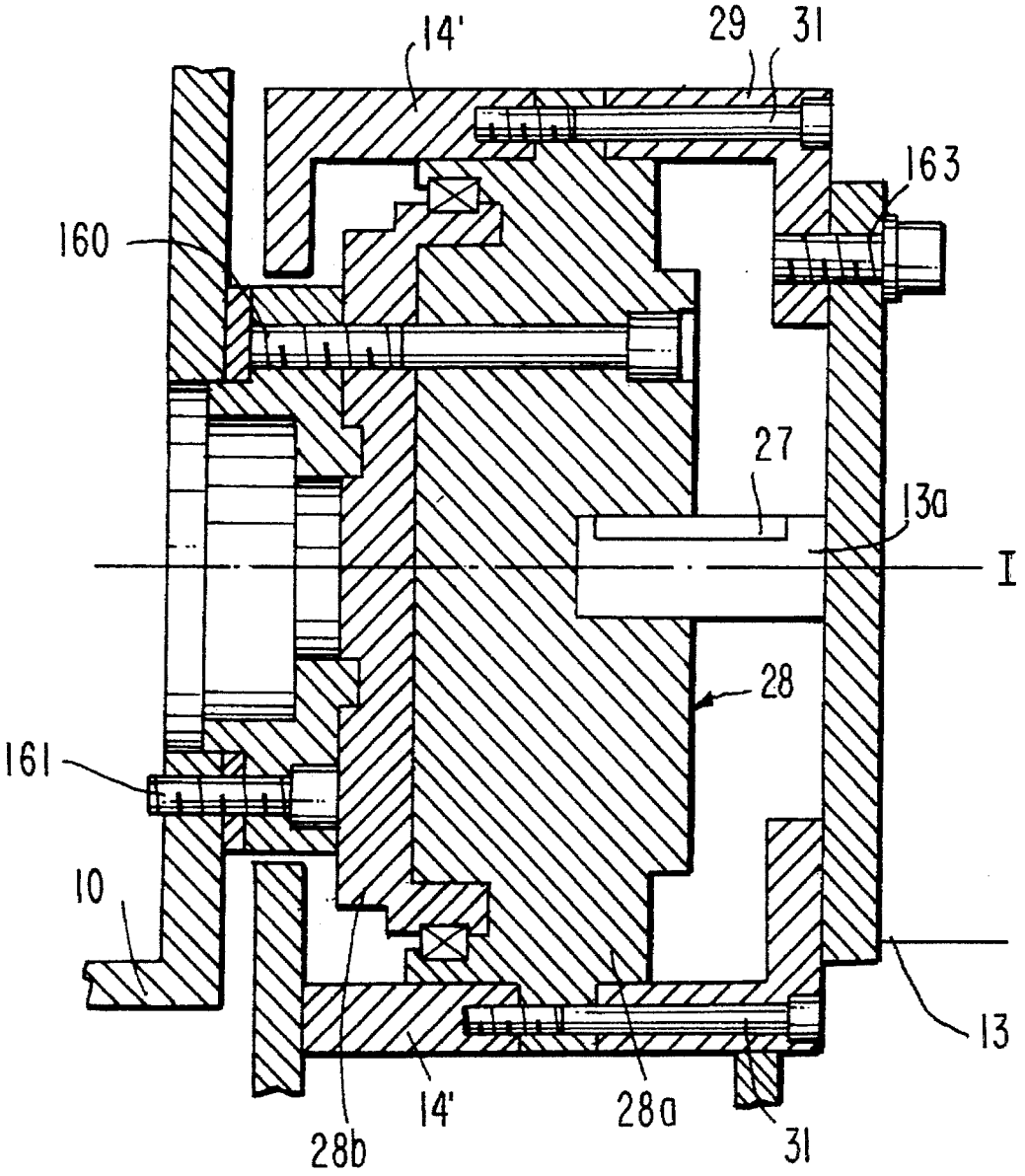
FIG. 4 is a sectional front elevational view of an arm driving mechanism of the embodiment.

2. Arm Driving Mechanism:

As shown in FIG. 4, the drive shaft 13*a* of the electric motor 13 is connected via a key 27 to a conventional speed reducer 28, and a rotation section 28*a* of the speed reducer 28 is connected to the box-shaped arms 14, 14' so that, a rotational drive force from the electric motor 13 transmitted through the speed reducer 28 to the arms 14, 14' for rotation of the arms 14, 14' about the first rotation axis I. A fixed portion of the speed reducer 28 is secured to the base 10 by screws 160, 161, and the motor 13 is secured to a motor flange 29 via a screw 163.

3. Rotational-Body Driving Mechanism:

Next, primarily with reference to FIGS. 5 and 6, a description will be given on a driving mechanism for the rotational body 15 that i s rotatable about the second rotation axis H .

Figure 5:
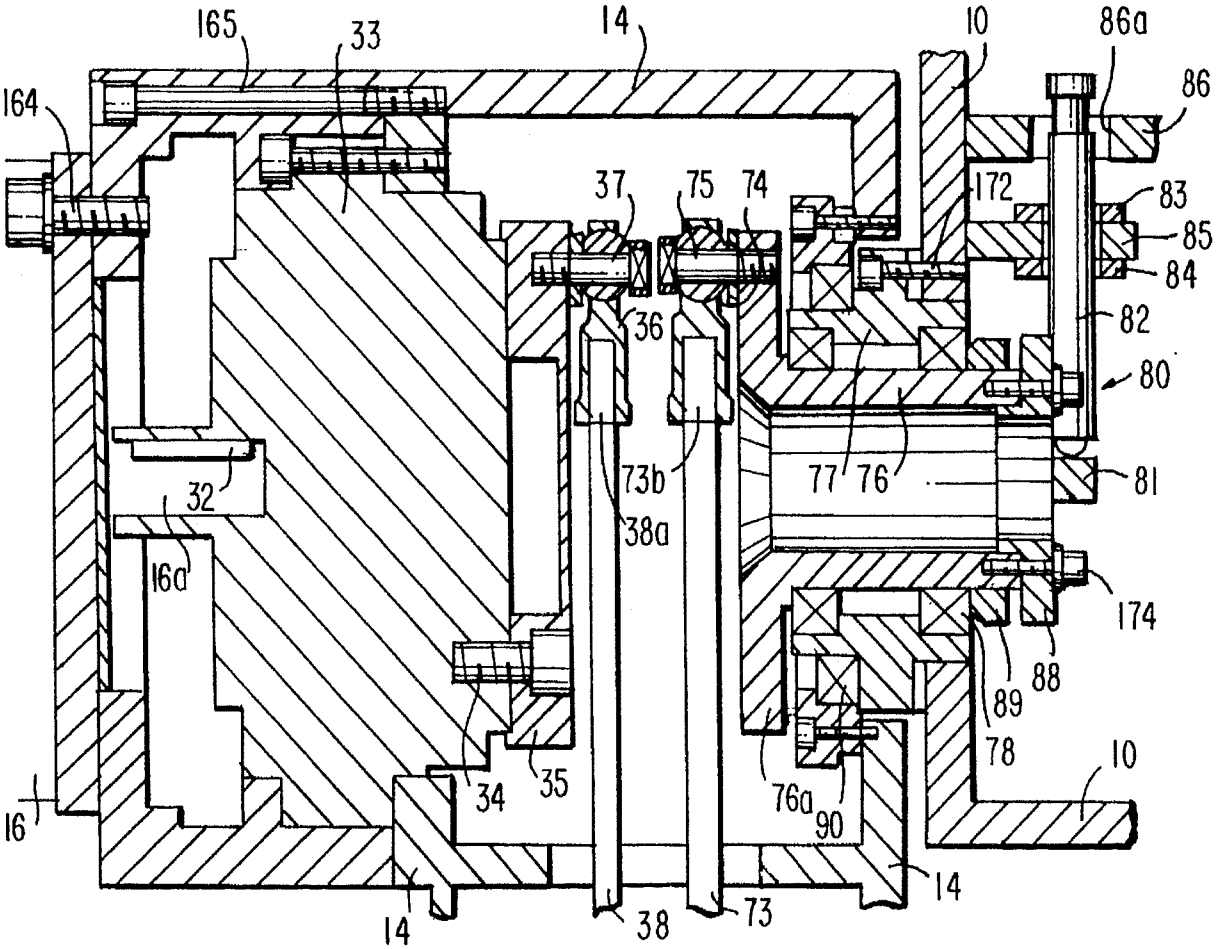
FIG. 5 is a sectional front elevational view showing part of a driving section for a rotational body in the embodiment.

As shown in FIG. 5, the drive shaft 16*a* of the electric motor 16 secured to the motor flange 165 via a screw 164 connected to a conventional speed reducer 33 via a key 32, and a link-rod mounting metal member 36 is provided for pivotal movement about a horizontal pin 37 that is embedded in a flange 35 connected to the speed reducer 33 via a screw 34. Into a threaded hole formed in the link-rod mounting member 36 is fixedly screwed a threaded upper end portion 38*a* of a downwardly-extending link rod 38.

Figure 6:
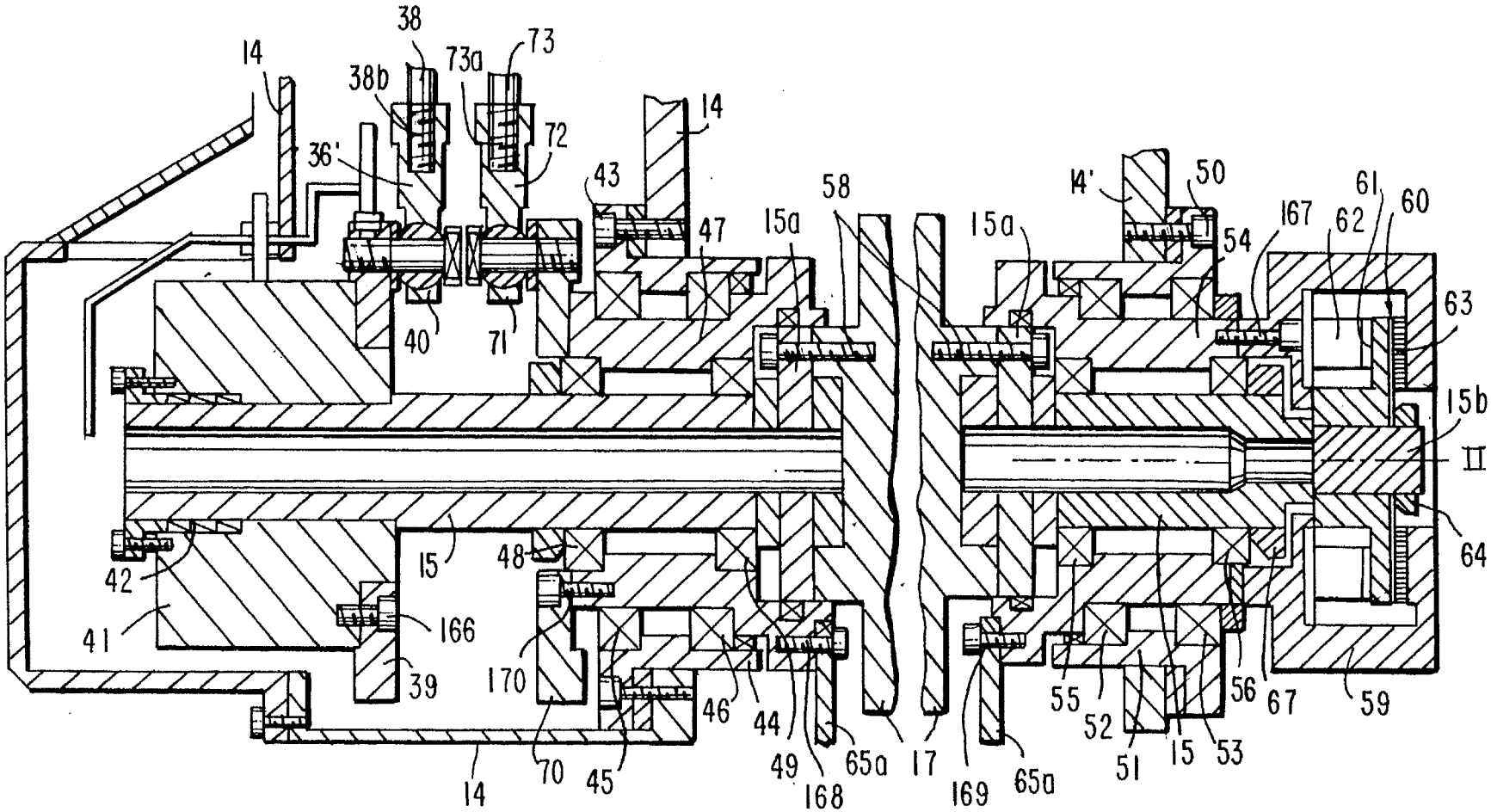
FIG. 6 is a sectional front elevational view of the rotational body.

A threaded lower end portion 38*b* of the link rod 38 is fixedly screwed into a threaded hole formed in another link-rod mounting metal member 36' as shown in FIG. 6. The link-rod mounting member 36' is provided for pivotal movement about a horizontal pin 40 that is embedded in a torque guard flange 39. A torque guard 41 is secured to the torque guard flange 39 via a screw 166. The hollow rotational body 15 is disposed in the central portion of the torque guard 41 coaxially with the guard 41, so that the body 15 is rotatable with the torque guard 41. Accordingly, a rotational drive force is transmitted, through the speed reducer 33, flange 35, link-rod mounting member 36, link rod 38, link-rod mounting member 36', torque guard flange 39, torque guard 41 and a frictional joint 42, to the rotation shaft 15, so that the shaft 15 is caused to rotate about the second rotation axis II.

An arm flange 44 is fixed to the arm 14 by a screw 43, and the rotation shaft 15 is supported at one end portion by the arm flange 44 via bearings 45, 46, a hollow shaft 47 (to be described later) and bearings 48, 49. In a similar manner, the other end portion of the rotation shaft 15 is supported by an arm flange 51 fixed to the arm 14', via bearings 52, 53, hollow shaft 54 (to be described later) and bearings 55, 56.

As shown in FIG. 6, the rotation shaft 15 has increased diameter portions 15*a* which are connected to the opposite ends of the wiping-squeegee mounting mechanism 17 (illustration of the central portion of the mechanism 17 is omitted in FIG. 6). Thus, the rotational drive force of the electric motor 16 is transmitted from the left side portion (as viewed in FIG. 6) of the shaft 15 through the wiping-squeegee mounting mechanism 17 to the right side portion (as viewed in FIG. 6) of the shaft 15. The wiping squeegee 18 is attached to the wiping-squeegee mounting mechanism 17 for rotation with the rotation shaft 15.

4. Driving Mechanism for the Receiving Squeegee:

The wiping squeegee 18 rotates with the rotation shaft 15 as mentioned above, but the receiving squeegee 20, depending on the state of an electromagnetic clutch 60, either rotates with the rotation shaft 15 or is maintained in a predetermined position by a stopper 80 that prevents tendency of the squeegee 18 to pivot downward due to its dead load irrespective of the rotation of the shaft 15, as will be later described in detail.

A cylinder-shaped clutch chamber 59 is disposed in the right side portion (as viewed in FIG. 6) of the arm 14' and is secured to the hollow shaft 54 by a screw 167. In the clutch chamber 59, the electromagnetic clutch 60 comprised of a clutch plate 61, electromagnet 62 and clutch lining 63 is provided around a reduced-diameter portion **15*b* of the rotation shaft 15. Reference numerals 64 and 67 denote lock nuts locking the electromagnetic clutch 60** in place.

Figure 8:
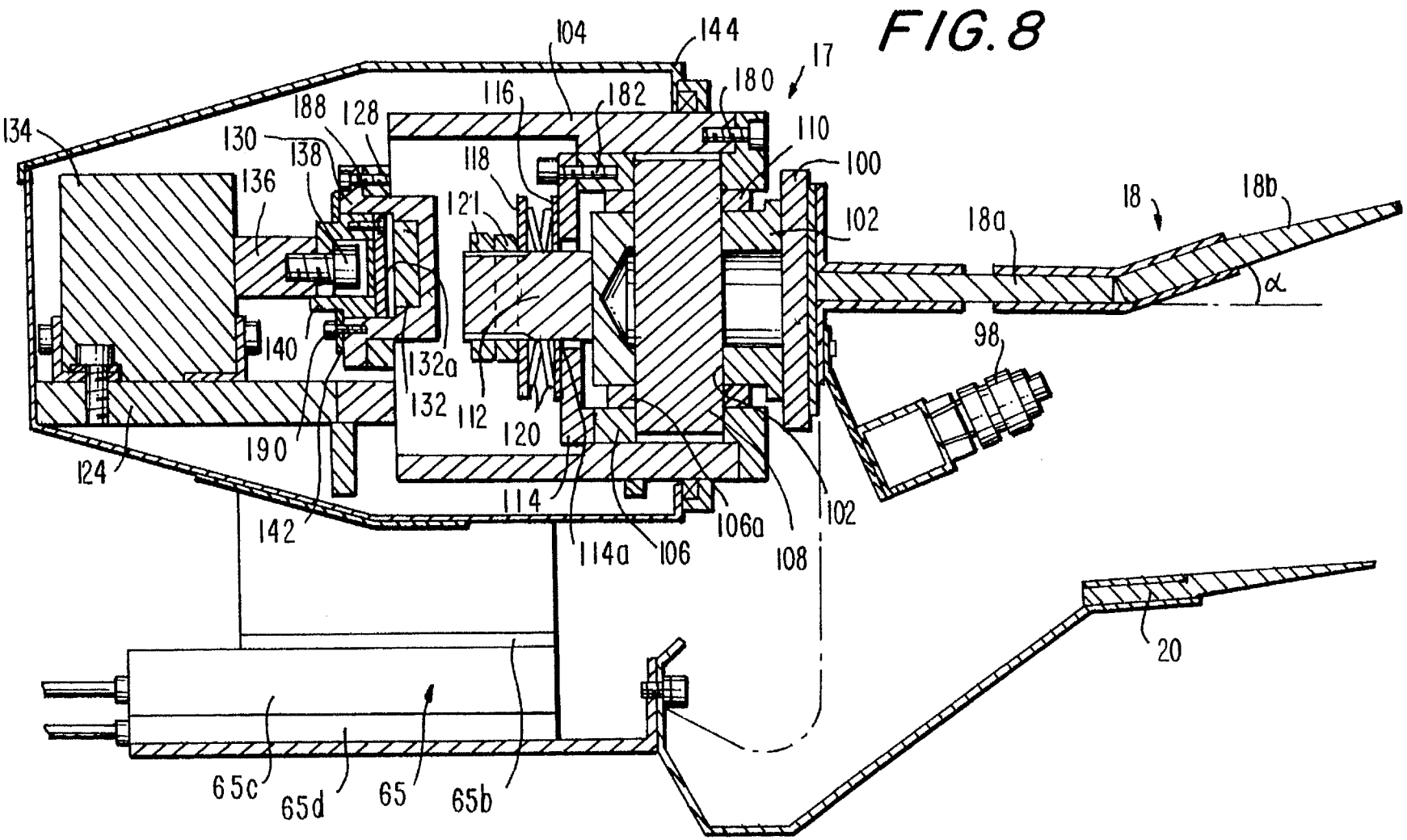
FIG. 8 is a sectional side elevational view of a wiping squeegee.
Figure 10:
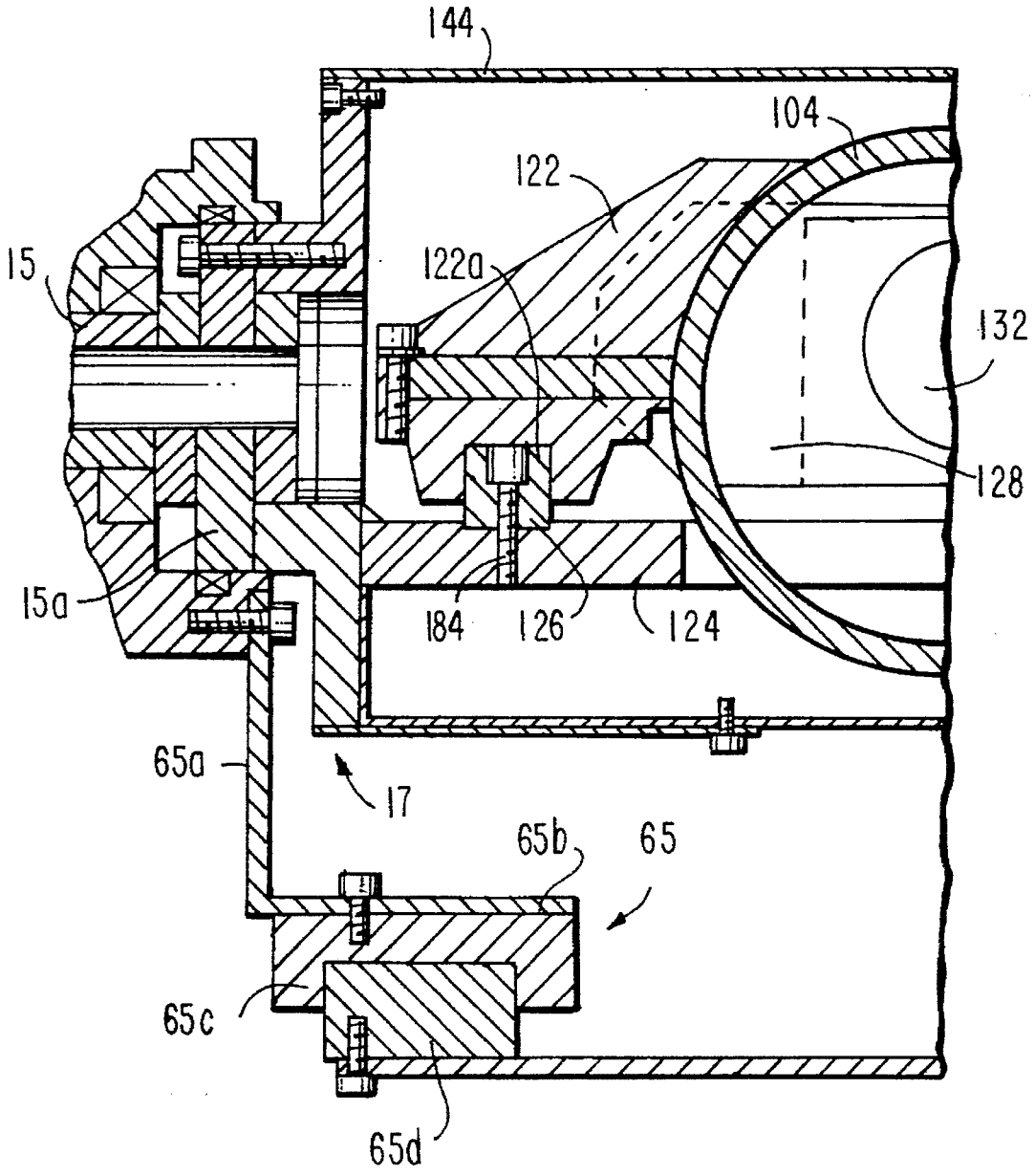
FIG. 10 is a view as viewed in a direction of arrow I—I of FIG. 9.
Figure 13:
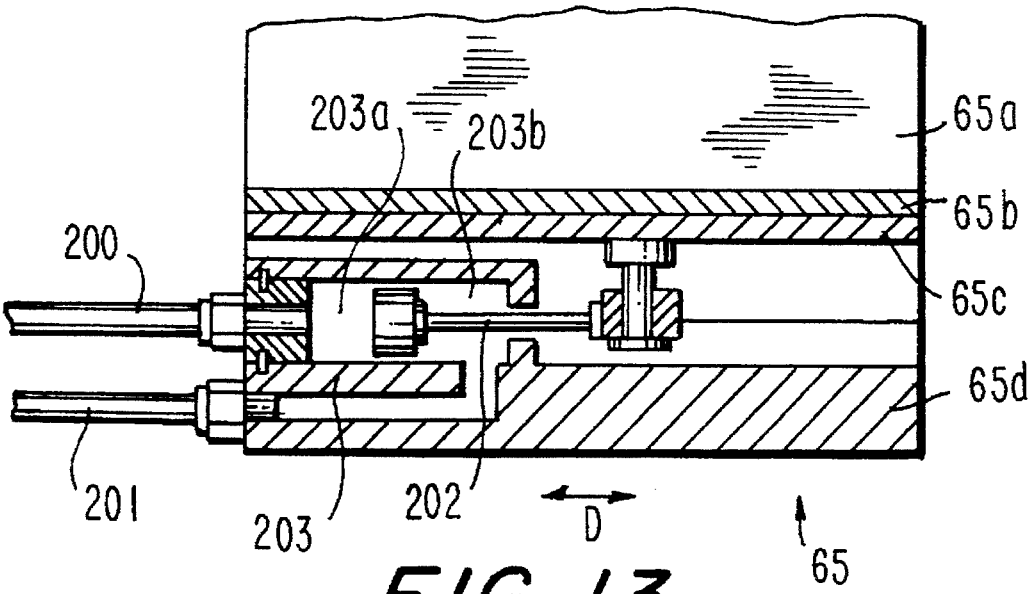
FIG. 13 is a sectional view of a mounting mechanism for the receiving squeegee employed in the embodiment.

Side plates **65*a* of a receiving-squeegee mounting section 65 (FIG. 2) are fixed to the hollow shafts 47 and 54, respectively, by screws 168 and 169, and the receiving squeegee 20 is secured to the mounting section 65 as shown in FIG. 2. The hollow shafts 47, 54 and mounting section 65 jointly constitute the receiving-squeege mounting mechanism 19 (FIG. 2). As shown in FIGS. 8 and 10, the receiving-squeegee mounting section 65 includes a slider 65*d* that is mounted to a slider base 65*c* secured to the underside of a horizontal plate 65*b* extending inwardly from and at right angles to the side plates 65*a*. The slider 65*d* is slidable in a forward and rearward direction relative to the slider base 65*c*. As further shown in FIG. 13 in section, the slider 65*d* includes a cylinder 203 in which a piston 202 is slidably fitted. The cylinder 203 has cylinder chambers 203*a* and 203*b* having one end connected to a pressurized air source via hoses 200 and 201, respectively and other end in communication with the atmosphere. Thus, by exposing the cylinder chambers 203*a*, 203*b* to the pressurized air or atmosphere, the slider 65*d* is caused to slide in a forward and rearward direction as indicated by arrows D. Further, the receiving-squeegee mounting section 65 includes a conventional air regulator (not shown) to keep constant the air pressure supplied to the cylinder 203. By the air regulator always keeping constant the air pressure within the cylinder chamber 203*a* irrespective of sliding movement of the slider 65*d*, the receiving squeegee 20** can be pressed against the windowpane surface with controlled constant pressure.

A microswitch may be employed to detect a distance from the receiving squeegee 20 to the windowpane surface, and the slider **65*d*** may be driven by an electric motor or other suitable driving means.

When the electromagnetic clutch 60 is in a disconnecting state, the hollow shafts 47, 54 and hence the receiving-squeegee mounting mechanism 19 are disconnected or freed from the rotation shaft 15. In this state, the receiving squeegee 20 is prevented by a later described stopper mechanism from pivoting downward from the predetermined horizontal position due to its dead weight, while having capability to pivot in the opposite direction, i.e., upwardly about the rotation shaft 15.

A flange 70 is secured to the hollow shaft 47 via a screw 170, and a link-rod-mounting metal member which has the same construction as the above-mentioned link-rod-mounting metal members 36, 36' is provided for pivotal movement about a horizontal pin 71 embedded in the flange 70. In a threaded hole in the link-rod mounting metal member 72 is fixedly screwed a threaded lower end portion **73*a* of an upwardly extending link rod 73**.

A threaded upper end portion **73*b* (FIG. 5) of the link rod 73 is fixedly screwed in a threaded hole of a link-rod mounting metal member 74 that is identical in structure to the above-mentioned link-rod mounting metal member 72. The link-rod mounting metal member 74 is pivotably mounted about a horizontal pin 75 embedded in an increased-diameter flange portion 76*a* of a stopper mounting hollow shaft 76**.

Figure 7:
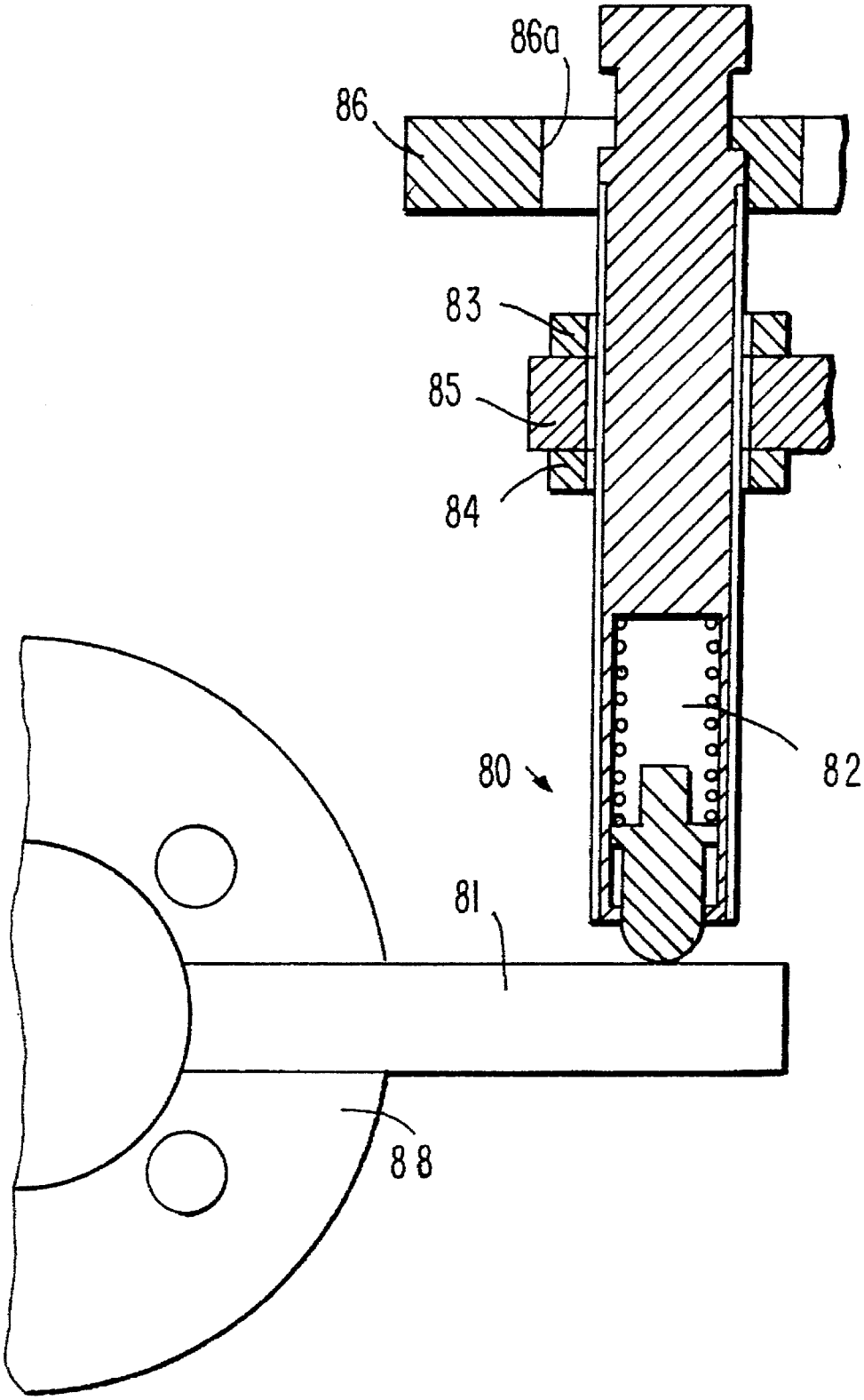
FIG. 7 is a side elevational view of a stopper to prevent a receiving squeegee from undesirably pivoting downward.

The stopper mounting hollow shaft 76 is rotatably supported, via bearings 78, 79, by a hollow shaft 77 that is secured to the aforementioned base 10 by a screw 172 The hollow shaft 77 enables a pivotal movement of the arm 14 by way of a bearing 90. A horizontal rod 81 of a stopper 80 as shown in FIGS. 5 and 7 is welded to a flange 88 secured to an end of the stopper mounting hollow shaft 76 adjacent to the base 10, to extend from the shaft 76 in a horizontal direction. The stopper 80 includes a shock absorber 82 that abuts at its lower end against the horizontal rod 81 and extends in a vertical direction. The shock absorber 82 is in threaded engagement with a stopper support plate 85 extending horizontally from the base 10 in such a manner that the height of the absorber can be adjusted. The upper end of the shock absorber projects upwardly through an opening **86*a* formed in stopper support plate 86 that extends horizontally from the base 10. Reference numerals 83, 84, and 89** denote lock nuts.

Thus, when the electromagnetic clutch 60 is in a disconnecting state in the illustrated condition, the receiving squeegee 20 will pivot downward from the horizontal position due to its dead weight, and thus the hollow shaft 47 securing the receiving-squeegee mounting section 65 will also pivot in a clockwise direction as viewed from the left of the figure. This pivotal force is transmitted to the stopper mounting hollow shaft 76 via the link rod 73 so that the shaft 76 will pivot in a clockwise direction as viewed from the left of the figure. In this manner, the horizontal rod 81 of the stopper 80 will move upward. But, in effect, the rod 81 is prevented from moving upward by the shock absorber 82 locking the horizontal rod 81. In this way, the receiving squeegee 20 is maintained in the horizontal position.

When, during descending movement of the robot, the receiving squeegee 20 abuts against a window frame or the like and may be forced to pivot upward, and thus the stopper mounting hollow shaft 76 will pivot in a counterclockwise direction as viewed from the left of the figure. But, in this case, the horizontal rod 81 of the stopper 80 is caused to move downwardly, so that the squeegee 20 is not constrained by the shock absorber 82 and thus can freely pivot upward about the second rotation shaft II.

Next, a description will be made below on how the receiving squeegee 20 operates when the electromagnetic clutch 60 is in a connecting state. Upon energization of the electromagnet 62 of the electromagnetic clutch 60, the clutch plate 61 is caused to press against the clutch lining 63 to thereby bring the clutch 60 into a connecting state. If the rotational body 15 is pivoted with the clutch 60 in the connecting state, the pivotal movement is transmitted to the clutch chamber 59 via the electromagnetic clutch 60 and further transmitted via the hollow shaft 54 to the receiving-squeegee mounting section 65 secured to the shaft 54. Thus, in this case, the receiving squeegee 20 rotates with the rotation shaft 15. But, also in this case, the stopper 80 prevents the receiving squeegee 20 from pivoting downwardly from the horizontal position, and thus the squeegee 20 is pivotable only upwardly from the horizontal position.

5. Mounting Mechanism for the Wiping Squeegee:

Next, primarily with reference to FIGS. 8 to 10, a description will be given on the wiping-squeegee mounting mechanism 17.

The wiping squeegee 18 extending in parallel with the outer wall surface is fixedly attached to a rectangular squeegee mounting flange 100 that extends the same length as the squeegee 18. The squeegee mounting flange 100 is secured at its central portion to a cylinder shaped hollow shaft 102. The wiping squeegee 18 has a proximal end portion 18*a* extending in the horizontal direction and a distal end portion 18*b* extending obliquely upwardly at degree α with respect to a horizontal plane. The construction of the squeegee 18 is conventionally known. Reference numeral 98 denotes a nozzle for spraying water. A pin mounting hollow shaft 106 is fixed to the interior of a cylindrical housing 104 by a pin 180 and has a pin mounting opening 106*a* in which a vertical pin 108 is fitted and secured to the hollow shaft 106. The hollow shaft 102 to which the squeegee mounting flange 100 is secured has, its central portion, a vertical through-hole 102*a*, in which the pin 108 is loosely fitted so that the hollow shaft 102 is pivotable about the pin 108. Reference numeral 110 denotes a bearing.

A coned-dish-spring mounting rod 112 is fixed to the rear end of the hollow shaft 102, and the mounting rod 112 projects rearwardly through an opening 114*a* that is formed in a flange 114 fixedly attached to the rear end of the hollow shaft 106 by a screw 182. Two coned-dish spring holding rings 116 and 118 are fitted around the mounting rod 112 in spaced apart relation to each other, and a coned-dish spring 120 is mounted between the holding rings 116 and 118. Adjusting the urging force of the coned-dish spring 120 by means of nuts 121 can adjust the restoring force of the wiping squeegee 18 from its inclined position on the horizontal plane.

Figure 9:
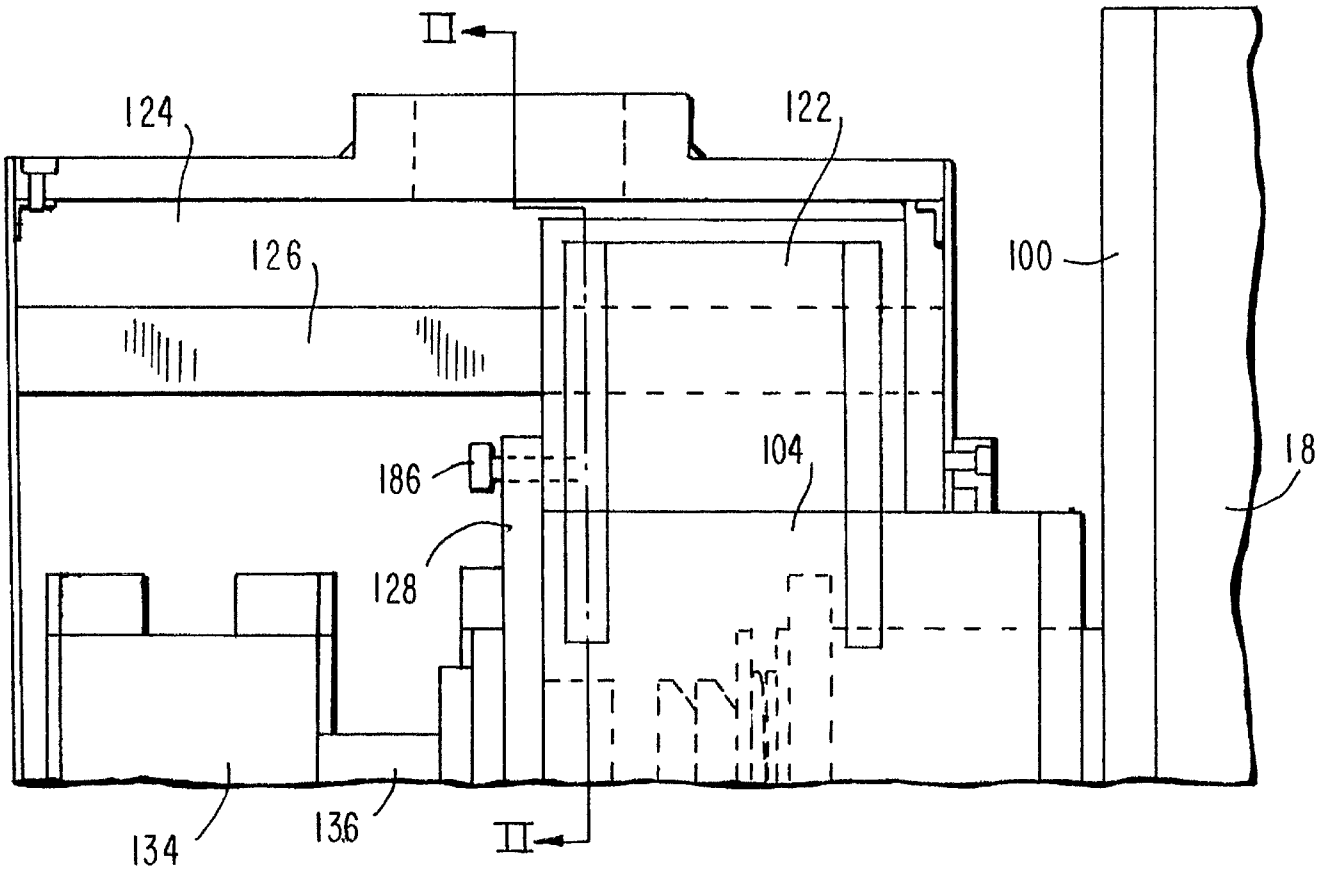
FIG. 9 is a top plan view of the wiping squeegee.

On both sides of the cylindrical housing 104, overhang portions 122 are formed integrally with the housing 104 as shown in FIGS. 9 and 10. Each of the overhang portions 122 has, in its underside, a recess 122*a* extending in the forward/rearward direction. In the recess 122*a* is fitted a guide rail 126, and this rail 126 extends along the recess 122*a* in the forward/rearward direction and is secured to a base plate 124 by a screw 184. This allows the housing 104 to slide along the guide rail 126 in the forward and rearward directions, i.e., toward and away from the wall surface.

A rectangular mounting plate 128 is secured to the rear end of the housing overhang portion 122 via a screw 186 (FIG. 9). A pressure-sensor receiving cylinder 130 (FIG. 8) is secured to the mounting plate 128 by a screw 188 so that a closed fore end of the cylinder 130 is exposed in the housing 104. A disc-shaped pressure sensor 132 is received in a stepped portion formed in the fore end portion of the pressure-sensor receiving cylinder 130.

An air cylinder 134 is mounted in the rear portion of the base plate 124, and an air cylinder head 140 secured to a piston 136 of the air cylinder 134 by a screw 138 is fitted into the rear portion of the pressure-sensor receiving cylinder 130 and in contact with a sensor projection 132*a* of the pressure sensor 132. A ring-shaped locking plate 142 is fixedly attached to the rear end surface of the receiving cylinder 130 by a screw 190 and engages a stepped portion of the air cylinder head 140 to limit a rearward movement of the air cylinder head 140. Reference numeral 144 denotes a cover for the wiping-squeegee mounting mechanism 17.

The pressure sensor 132 detects a pressing force applied from the wiping squeegee 18 to the windowpane and provides the air cylinder 134 with an electrical signal representing the pressing force. If the pressing force represented by the electrical signal is above a preset value, the air cylinder 134 reduces the pressure to be given to the piston, but if the pressing force is below the preset value, the air cylinder 134 increases the pressure to be given to the piston 136. This causes the housing overhang portions 122 to slide along the guide rail 126, in response to which the receiving squeegee 18 moves toward or away from the windowpane so that the squeegee pressing force is maintained at the preset value.

When the robot body moves out of parallel with the window pane during a cleaning operation with the receiving squeegee 18 pressed against the windowpane, the hollow shaft 102 securing the wiping squeegee 18 pivots about the pin 108 in such a manner to restore and maintain the wiping squeegee 18 in parallel with the windowpane.

Figure 11:
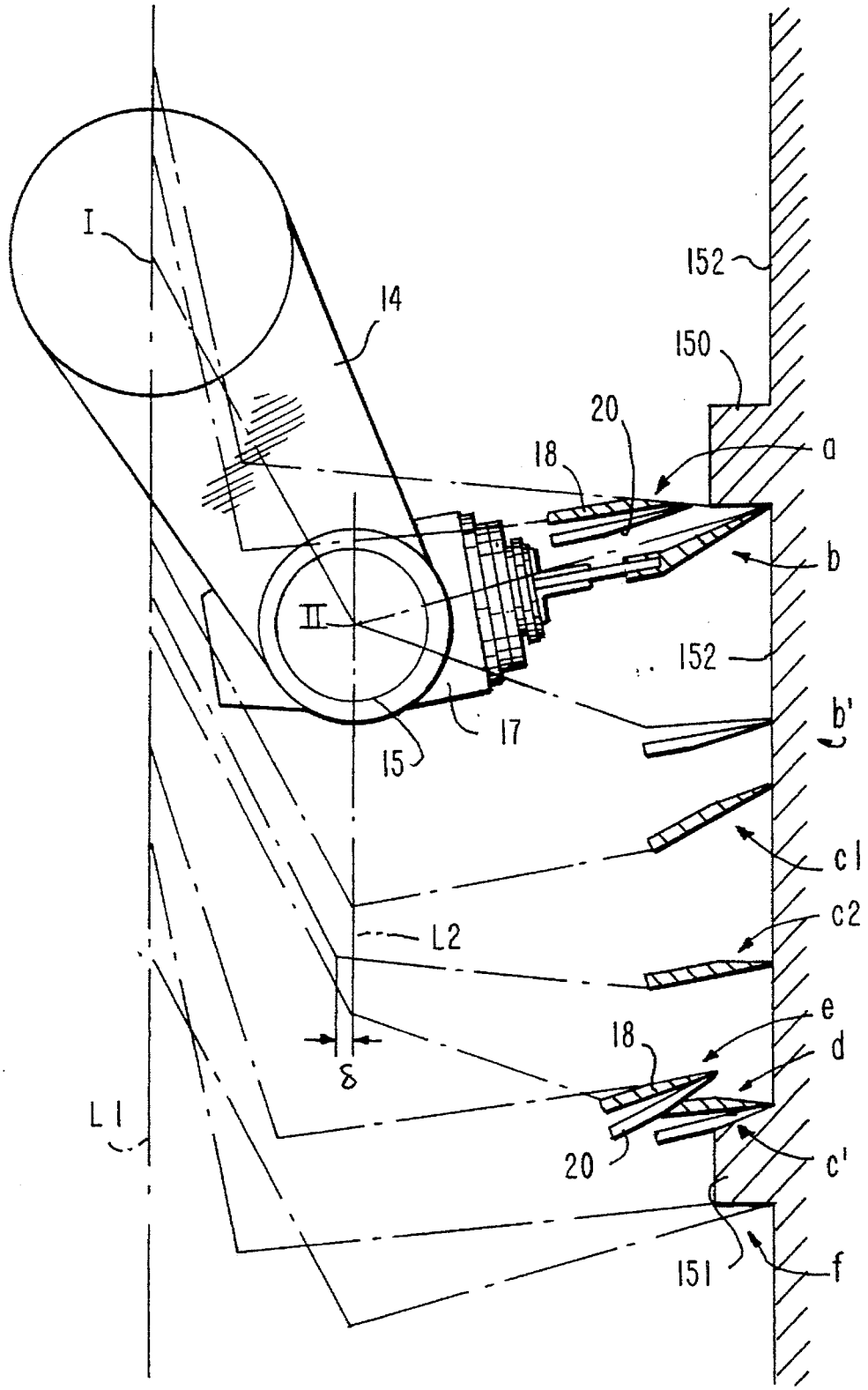
FIG. 11 is a view explanatory of the operation of the squeegees.
Figure 12:
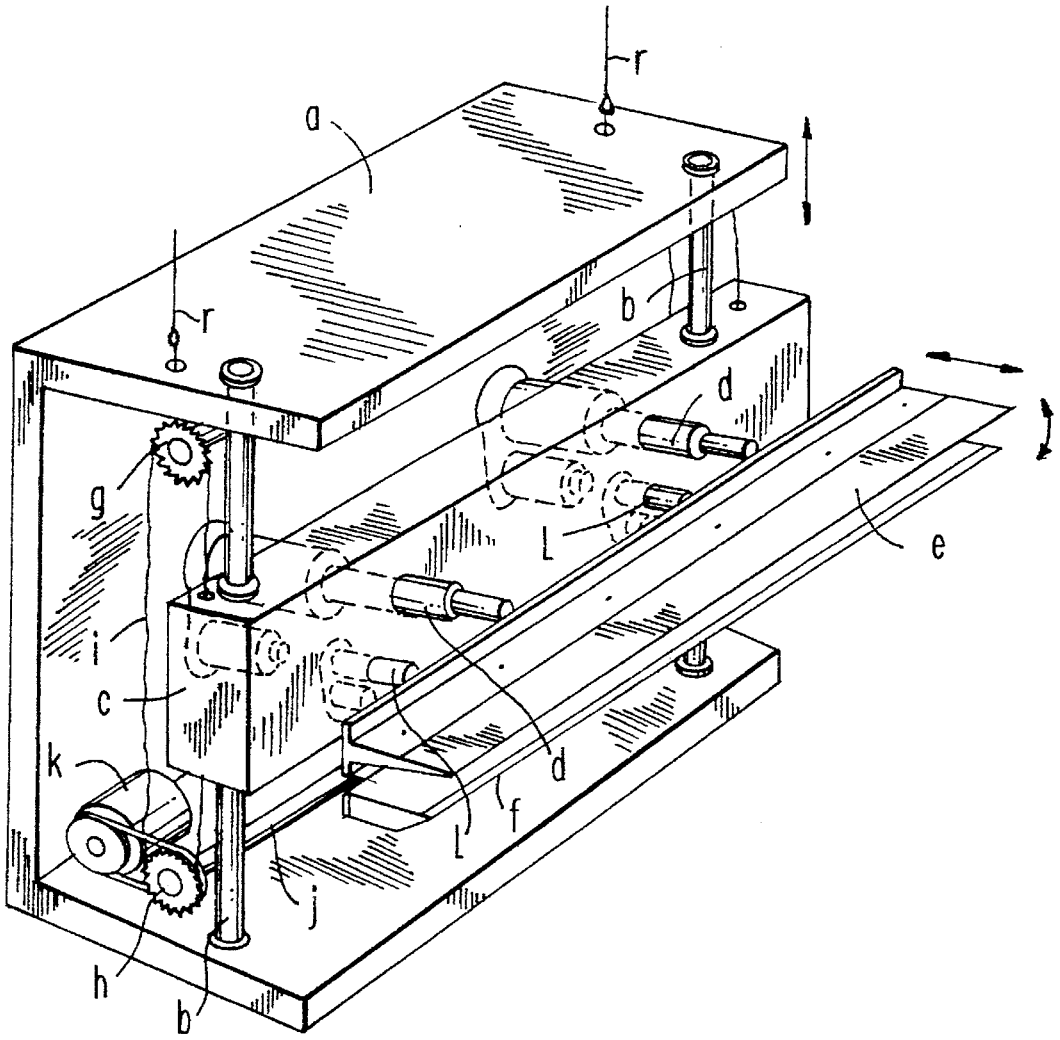
FIG. 12 PRIOR ART
FIG. 12 is a perspective view showing the essential part of a prior art window cleaning robot.

6. Operation of the Two Squeegees:

Next, with reference to FIG. 11, a description will be made on the operation of the wiping squeegee 18 and receiving squeegee 20 during cleaning of the windowpane.

In a standby position as shown by reference character a, both of the squeegees 18 and 20 are spaced apart from a window 152 so as not to contact a window frame 150. The first rotation axis I of the arm 14 moves down a vertical line L1 as the robot 1 descends along the windowpane. In this standby position, the rotational body 15 and the receiving squeegee 20 are interconnected by means of the electromagnetic clutch 60 so that the squeegees 18, 20 together are rotatable with the rotational body 15.

Then, the arm 14 is caused to pivot in a counterclockwise direction about the first rotation axis I while the robot 1 moves downward from the standby position, and thereby the wiping squeegee 18 is brought into contact with the window 152 immediately below the window frame 150 and is positioned at a cleaning start point b. At the same time, the electromagnetic clutch 60 is placed into the disconnecting state so that the receiving squeegee 20 is pivoted downward due to its dead weight and is positioned at a point b' below the the wiping squeegee 18 positioned at the cleaning start point b. At this position b', the receiving squeegee 20 is able to receive thereon soiled water flowing down as the result of the cleaning operation by the wiping squeegee 20 and direct the received soiled water into the soiled water tank 26 provided within the robot Further, at this position, the receiving squeegee 20 is prevented from hanging down by the stopper 80. Then, as the robot 1 further moves downward while maintaining such a condition, cleaning of the windowpane 152 progresses in a downward direction.

Once the wiping squeegee 18 has moved from a position c1 to a position c2 during the progression of cleaning, the squeegee 18 performs the tilting movement to clean a portion of the windowpane 152 along the upper edge of a lower window frame 151. To this end, the rotation shaft 15 angularly moves in a clockwise direction about the second rotation axis II, the arm 14 pivots clockwise about the first rotation axis I, and the second rotation axis II moves rearward by a distance δ. At this time, the receiving squeegee 20 also will move rearward, but because of the above-mentioned slider mechanism designed to press the squeegee 20 against the windowpane 152 with a constant pressing force, the squeegee 20 moves forward so as not to be spaced apart from the windowpane 152. Because of such arrangements, the receiving squeegee 20 is prevented from moving apart from the windowpane along with the rearward movement of the second rotation axis II, and thus it is possible to avoid the inconvenience that the receiving squeegee 20 fails to receive dirty water flowing down from upward.

Before the wiping squeegee 18 completes cleaning a single windowpane 152, the receiving squeegee 20 reaches a position c' where the squeegee 20 abuts against the upper edge of the lower window frame 151. Even after the receiving squeegee 20 has reached the position c', the wiping squeegee 18 continues cleaning. But, since the receiving squeegee 20 is inhibited from further moving downward by being engaged with the upper edge of the window frame 151 and the electromagnetic clutch 60 is in the disconnecting state to allow the receiving squeegee 20 to freely pivot upward relative to the rotation shaft 15. Thus, the receiving squeegee 20 pivots counterclockwise about the second rotation shaft II while staying at the position c'.

When the wiping squeegee 18 has reached a cleaning end point d immediately above the window frame 151, both of the squeegees 18, 20, in response to a window frame detection signal from a sensor, perform such an action to avoid being caught by or hitting the window frame 151. Namely, the electromagnetic clutch 60 is placed into the connecting state to allow the two squeegees 18 and 20 to rotate together with the rotation shaft 15. At this time, the arm 14 is caused to pivot clockwise through a predetermined angle about the first rotation shaft I, and the rotation shaft 15 is caused to pivot in the counterclockwise direction. As the result of the combined pivotal movements of the arm 14 and rotation shaft 15, the two squeegees 18 and 20 are moved away from the windowpane 152 to a next standby position e.

Then, the robot 1 moves further downward, during which time the arm 14 is caused to rotate counterclockwise through a predetermined angle about the first rotation shaft I and the electromagnetic clutch 60 is brought into the disconnecting state, so that the wiping squeegee 18 is caused to abut against a next cleaning start point f. Thus, the robot 1 starts cleaning a next or lower windowpane 152 and repeats the above-mentioned actions. The aforementioned sequence of the cleaning operations is performed in accordance with preprogrammed servo control.

The rotational body, which has been described as comprising the rotation shaft 15 in the embodiment, may be of any other shape and construction as long as it can be supported by a box-shaped casing or arm for rotation about the second rotation shaft II.

Moreover, it will be appreciated that various modifications may be made without departing from the principle of the present invention.

As described thus far, in accordance with the invention, the upward/downward movement, forward/rearward movement and tilting movement of the wiping squeegee can be achieved by combining the pivotal movements of the arm pivotable about the first rotation axis, and of the rotational body that is supported by the arm and is pivotable about the second rotation axis parallel to the first axis independently of the pivotal movement of the arm. This eliminates the necessity of a drive shaft formerly used in the conventional Cartesian-coordinate-type window cleaning robots, and no serious problems such as damage to the drive shaft and positional imbalance of the squeegees will take place, whereby reliability of the robot will be enhanced.

Further, according to the invention, all the drive force transmission mechanisms are based on rotational structures and contain no sliding components, and thus the transmission mechanisms can be completely sealed, with utmost ease, by the use of commercially available, simple circular sealing member. This also achieves enhanced reliability of the robot.

Furthermore, because, as mentioned above, the upward/downward, forward/rearward and tilting movements of the wiping squeegee can all be achieved by combination of the pivotal movements of the arm and rotational body, the number of parts, size and weight of the driving mechanisms can be reduced to a substantial degree. Consequently, the roof car for suspending the robot can also be reduced in size.

In accordance with one aspect of the invention, the receiving-squeegee mounting mechanism rotatably supported relative to said rotational body is connected to or disconnected from the rotational body via the clutch mechanism: when the clutch is in the connecting state, the receiving squeegee is pivotable together with the rotational body, but when the clutch is in the disconnecting state, the receiving squeegee is held in a given position (horizontal position, for instance) irrespective of the pivotal movement of the rotational body, with its tendency to pivot downward due to its dead weight being constrained by the stopper mechanism. Thus, in the case of a normal window cleaning operation, upon detection of a window frame existing ahead in the cleaning direction, the clutch is put in the connecting state and thus the receiving squeegee, together with the wiping squeegee, moves away from the windowpane surface to avoid the obstructing window frame. During the cleaning operation, by putting the clutch in the disconnecting state, the receiving squeegee enables the rotational body to rotate freely so as to adjust the wiping squeegee to an optimum tilted position for cleaning, and the receiving squeegee can also be maintained at a position for receiving soiled water irrespective of the pivotal movement of wiping squeegee. As the result, the respective movements of the two squeegees can be freely combined to achieve an optimum squeegee operation necessary for the window cleaning.

Further, in accordance with the other aspect of the invention, because the arm driving mechanism and rotational body driving mechanism are provided separately from each other, load imparted to the arm is only from the wiping squeegee, receiving squeegee, rotational body and mechanisms for mounting the two squeegees to the rotational body, and no heavyweight motor sections are present within the arm. Accordingly, load imparted to the head case can be by far smaller than that in the conventional gate-type window cleaning robots, with the result that the window cleaning operation can be performed at an increased speed.

Moreover, in accordance with the other aspect of the invention, it is possible to avoid the inconvenience that the receiving squeegee fails to properly receive soiled water because of its rearward movement away from the windowpane when the second rotation axis is moved rearwardly so as to allow the tilting movement of the wiping squeegee during the windowpane cleaning operation. This can further guarantee the advantageous results attained by the invention.

What is claimed is:

1. An outer wall cleaning robot for cleaning a vertical outer wall surface of a building, comprising:

an arm pivotable about a first rotation axis that extends in a substantially horizontal direction in approximately parallel relation to the vertical outer wall surface of the building when in use;

an arm driving mechanism connected to said arm for driving said arm to pivot about the first rotation axis;

a rotational body supported by said arm in such a manner that said rotational body is pivotable about a second rotation axis extending in parallel with said first rotation axis;

a rotational-body driving mechanism for driving said rotational body independently of driving of said arm by said arm driving mechanism;

a wiping-squeegee mounting mechanism operably connected to said rotational body; and a wiping squeegee attached to said mounting mechanism.

2. An outer wall cleaning robot as defined in claim 1 which further comprises water supplying means for supplying clear water on the outer wall surface during cleaning of the outer wall, a receiving-squeegee mounting mechanism pivotally connected to said rotational body, a receiving squeegee attached to said receiving squeegee mounting mechanism so as to be positioned below said wiping squeegee for receiving soiled water resultant from cleaning of the outer wall, a clutch mechanism connected to said rotational body for connecting and disconnecting said receiving squeegee to and from said rotational body, and a stopper mechanism connected to said receiving-squeegee mounting mechanism for preventing, when said receiving squeegee is disconnected from said rotational body, said receiving squeegee from pivoting downward from a predetermined position.

3. An outer wall cleaning robot as defined in claim 1 or 2 wherein said arm driving mechanism and said rotational-body driving mechanism each comprise a motor connected to said arm.

4. An outer wall cleaning robot as defined in claim 2 wherein said receiving-squeegee mounting mechanism includes a slider base, a slider mounted to said slider base for sliding movement along said slider base in a forward and rearward direction, and drive means for driving said slider, and wherein said receiving squeegee is fixed to said slider.

5. An outer wall cleaning robot as defined in claim 1 wherein said wiping-squeegee mounting mechanism comprises a squeegee mounting section to which said wiping squeegee is fixedly secured, and a squeegee mounting section supporting section having a central portion and a vertical pin located approximately in said central portion of said squeegee mounting section supporting section and on which said squeegee mounting section is horizontally pivotably mounted.

6. An outer wall cleaning robot as defined in claim 5 wherein said wiping-squeegee mounting mechanism further comprises:

squeegee mounting section supporting section drive means coupled to said squeegee mounting section supporting section for driving said squeegee mounting section supporting section toward and away from the outer wall surface of the building;

guide means provided on opposite sides of said squeegee mounting section supporting section for guiding the movement of said squeegee mounting section supporting section toward and away from the outer wall surface of the building;

a pressure sensor provided in contact with said squeegee mounting section supporting section for detecting pressure of the wiping-squeegee against a windowpane, of the building; and drive control means connected to said squeegee mounting section supporting section drive means and said pressure sensor for controlling said squeegee mounting section supporting section drive means in such a manner that said squeegee mounting section supporting section is caused to move toward the windowpane when pressure detected by said pressure sensor is below a preset value and said squeegee mounting section supporting section is caused to move away from the windowpane when pressure detected by said pressure sensor is above the preset value.

* * * * *